US010306954B2

(12) United States Patent
Kojima et al.

(10) Patent No.: US 10,306,954 B2
(45) Date of Patent: Jun. 4, 2019

(54) SLIDE FASTENER CHAIN AND SLIDE FASTENER

(71) Applicant: YKK Corporation, Tokyo (JP)

(72) Inventors: Yoshinori Kojima, Toyama (JP); Hayuru Tanaka, Toyama (JP); Isamu Michihata, Toyama (JP); Yui Miyawaki, Toyama (JP)

(73) Assignee: YKK Corporation (JP)

( * ) Notice: Subject to any disclaimer, the term of this patent is extended or adjusted under 35 U.S.C. 154(b) by 374 days.

(21) Appl. No.: 15/024,835

(22) PCT Filed: Sep. 29, 2014

(86) PCT No.: PCT/JP2014/075845
§ 371 (c)(1),
(2) Date: Mar. 24, 2016

(87) PCT Pub. No.: WO2015/046497
PCT Pub. Date: Apr. 2, 2015

(65) Prior Publication Data

US 2016/0242514 A1 Aug. 25, 2016

(30) Foreign Application Priority Data

Sep. 30, 2013 (WO) ..... PCT/JP2013/076581

(51) Int. Cl.
*A44B 19/02* (2006.01)
*A44B 19/04* (2006.01)
(Continued)

(52) U.S. Cl.
CPC ..... *A44B 19/02* (2013.01); *A44B 19/04* (2013.01); *A44B 19/06* (2013.01); *A44B 19/24* (2013.01); *A44B 19/36* (2013.01); *Y10T 24/255* (2015.01)

(58) Field of Classification Search
CPC ..... Y10T 24/2539; Y10T 24/2543; Y10T 24/2548; Y10T 24/255; Y10T 24/2552;
(Continued)

(56) References Cited

U.S. PATENT DOCUMENTS 4,441,235 A * 4/1984 Kusayama ..... A44B 19/36 24/433
4,513,483 A * 4/1985 Kasai ..... A44B 19/06 24/409
(Continued)

FOREIGN PATENT DOCUMENTS

JP 47-037061 B1 9/1972
JP 036119/1982 2/1982
(Continued)

OTHER PUBLICATIONS

International Search Report, PCT Application No. PCT/JP2014/075845, dated Dec. 22, 2014.
(Continued)

*Primary Examiner* — Abigail E Troy
(74) *Attorney, Agent, or Firm* — Kilpatrick Townsend & Stockton LLP

(57) ABSTRACT

There is provided a side fastener chain. A plurality of elements are fixed on each of opposing edge portions of a pair of fastener tapes at a predetermined pitch. The elements include a base portion and a head portion. A ratio (Rt) of the sum dimension of a first partial thickness, which is measured from an upper surface of each element to an upper surfaces-side apex of the respective edge portion, and a second partial thickness, which is measured from a lower surface of the element to a lower surface-side apex of the edge portion, to a thickness of the element satisfies the following equation:
(Continued)

40%≤Rt. A ratio (Rtl) of the thickness of the element to the entire length of the element satisfies the following equation: 0<Rtl<60%.

9 Claims, 14 Drawing Sheets

(51) Int. Cl.
*A44B 19/24* (2006.01)
*A44B 19/06* (2006.01)
*A44B 19/36* (2006.01)

(58) Field of Classification Search
CPC . Y10T 24/2557; Y10T 24/2559; A44B 19/02; A44B 19/36; A44B 19/06; A44B 19/24; A44B 19/04
See application file for complete search history.

(56) References Cited

U.S. PATENT DOCUMENTS

| | | | |
|---|---|---|---|
| 2012/0246886 | A1 | 10/2012 | Matsumoto et al. |
| 2013/0097819 | A1 | 4/2013 | Kojima |

FOREIGN PATENT DOCUMENTS

| | | | |
|---|---|---|---|
| JP | 164509/1984 | | 11/1984 |
| JP | 2006-149707 | A | 6/2006 |
| WO | 2010/140231 | A1 | 12/2010 |
| WO | 2011/064893 | A1 | 6/2011 |
| WO | 2012/004871 | A1 | 1/2012 |
| WO | 2012/090276 | A1 | 7/2012 |

OTHER PUBLICATIONS

Written Opinion, PCT Application No. PCT/JP2014/075845, dated Dec. 22, 2014.

* cited by examiner

SLIDE FASTENER CHAIN AND SLIDE FASTENER

This application is a national stage application of PCT/JP2014/075845, which claims priority to PCT/JP2013/076581, both of which are incorporated herein by reference.

TECHNICAL FIELD

The present invention relates to a slide fastener chain and a slide fastener in which resin elements are injection-molded on tapes.

BACKGROUND ART

Conventionally, for products requiring flexibility, slide fastener chains in which elements are formed of a coil-shaped resin have been often used. However, as products are diversified, needs of wanting to use various slide fastener chains having different designs depending on products requiring flexibility is being increased.

Conventionally, of slide fastener chains with elements attached on tapes by injection molding, a slide fastener chain which can be bent with a small radius is known (see Patent Document 1).

PRIOR ART DOCUMENT

Patent Document

Patent Document 1: Japanese Examined Patent Publication No. S47-37061

Patent Document 2: International Publication No. 2012/004871

SUMMARY OF INVENTION

Problems to be Solved by Invention

However, in the slide fastener chain described in Patent Document 1, detailed dimensions thereof are not described and a size of elements themselves is uncertain. Accordingly, it is actually uncertain how small the radius is. Also, even if the slide fastener chain can be bent with the small radius, it is uncertain whether or not the slide fastener chain has flexibility enough to be smoothly bent.

Also, in Patent Document 2, ranges of dimensions of an element are generally described. However, a combination of the entire length, width and thickness of the element, which is suitable to a fastener which has flexibility, a necessary and sufficient strength and also a thinner form and is excellent in design ability, is not disclosed and suggested.

An object of the present invention is to provide a slide fastener chain and a slide fastener, which have flexibility enough to be smoothly bent with a small curvature radius and also have a necessary and sufficient strength.

Means for Solving Problems

According to one embodiment of the present invention, there is provided a slide fastener including:

a pair of fastener tapes; and a plurality of elements fixed on each of opposing edge portions of the fastener tapes at a predetermined pitch;

wherein the elements includes a base portion fixed on the respective fastener tape and a head portion protruding from the base portion and configured to be engaged with the opposing elements;

wherein a ratio of the sum dimension of a first partial thickness, which is measured from an upper surface of each element to an upper surfaces-side apex of the respective edge portion, and a second partial thickness, which is measured from a lower surface of the element to a lower surface-side apex of the edge portion, to a thickness of the element satisfies the following equation (6), and wherein a ratio of the thickness of the element to the entire length of the element satisfies the following equation (7).

$$40\% \leq Rt \quad (6)$$

$$0 < Rtl < 60\% \quad (7)$$

In the slide fastener chain according to one embodiment of the present invention, the ratio (Rtl) of the thickness (t) of the element (3) to the entire length (l) of the element (3) satisfies the following equation (7').

$$0 < Rtl \leq 55\% \quad (7')$$

In the slide fastener chain according to one embodiment of the present invention, the ratio (Rt) of the sum dimension of the first partial thickness (ta), which is measured from the upper surface (3*c*) of the element (3) to the upper surfaces-side apex (211) of the edge portion (21), and the second partial thickness (tb), which is measured from the lower surface (3*b*) of the element (3) to the lower surface-side apex (212) of the edge portion (21), to the thickness (t) of the element (3) satisfies the following equation (6').

$$45\% \leq Rt \quad (6')$$

In the slide fastener chain according to one embodiment of the present invention, The thickness (t) and a pitch (p) of the element (3) satisfy the following equations (1) and (2).

$$0 < t \leq 2.2 \text{ mm} \quad (1)$$

$$0 < p \leq 3.5 \text{ mm} \quad (2)$$

In the slide fastener chain according to one embodiment of the present invention, a maximum load occurred when a loop portion formed by bending the slide fastener chain with the elements engaged is pressed from above satisfies the following equation (3).

$$0 < F \leq 6.5 \text{ N} \quad (3)$$

In the slide fastener chain according to one embodiment of the present invention, when one side of the slide fastener chain with the elements engaged is fixed and the other side is rotated about the fixed one side, an average value of an inclination of a load with respect to a curvature in the curvature of between 0.5 and 1.5 and an inclination in the curvature of between −0.5 and −1.5 satisfies the following equation (4).

$$0 < \alpha \leq 60 \times 10^{-4} \text{ Nm/m} \quad (4)$$

In the slide fastener chain according to one embodiment of the present invention, a dimension of a minimum gap between the adjacent elements is 0.4 mm or more.

According to one embodiment of the present invention, there is provided a slide fastener including:

the slide fastener chain;

stops fixed on the edge portions of the fastener tapes at terminating ends of element rows formed by the plurality of elements; and a slider movable to engage or disengage the element rows with or from each other.

Advantageous Effects of Invention

According to the present invention, a slide fastener chain and a slide fastener, which have flexibility enough to be smoothly bent with a small curvature radius, can be provided.

EMBODIMENTS OF INVENTION

Hereinafter, a slide fastener chain 1 will be described in detail by way of example with reference to the accompanying drawings.

Figure 1:
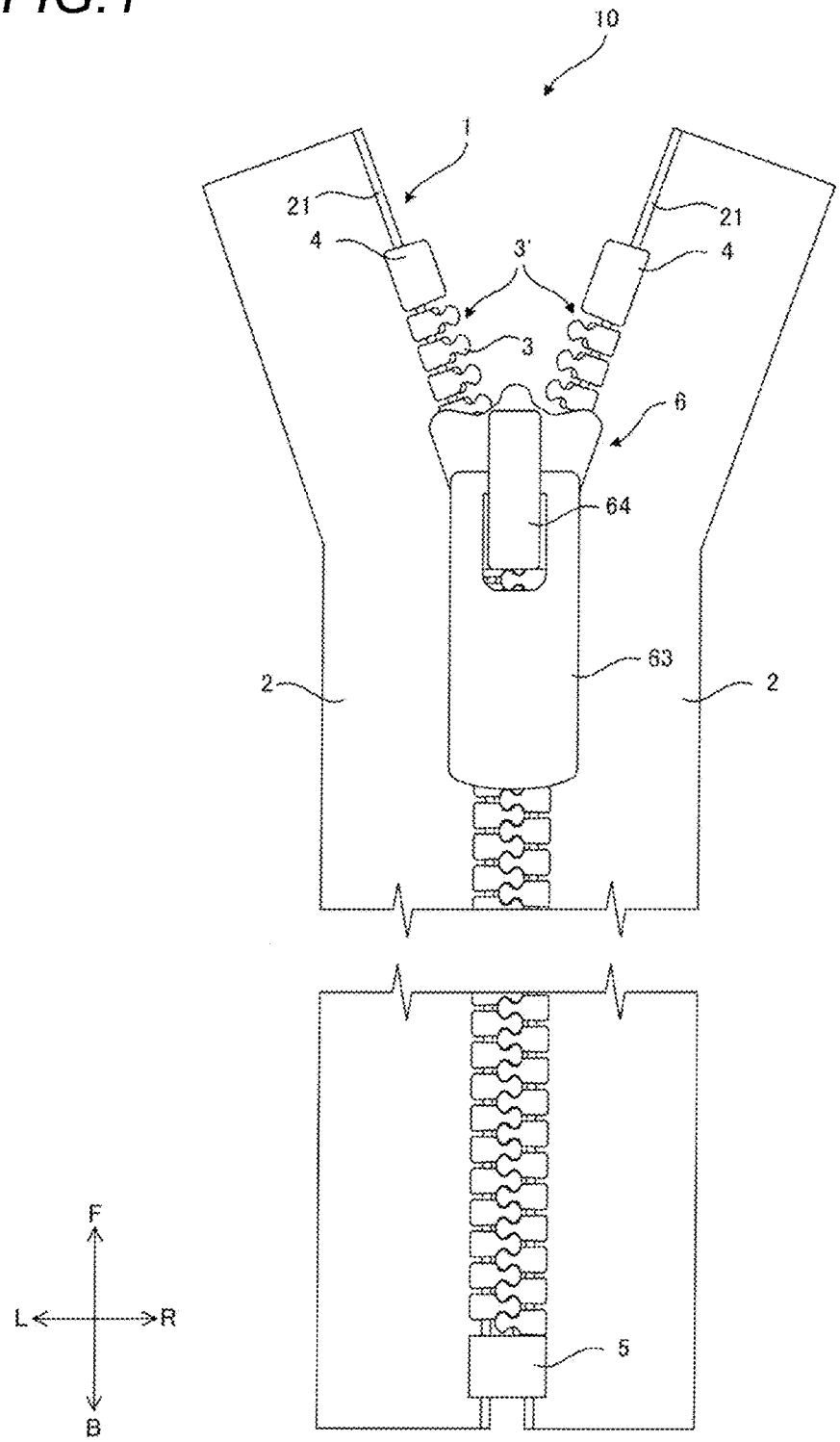
FIG. 1 is a front view showing a slide fastener according to present embodiment.
Figure 2:
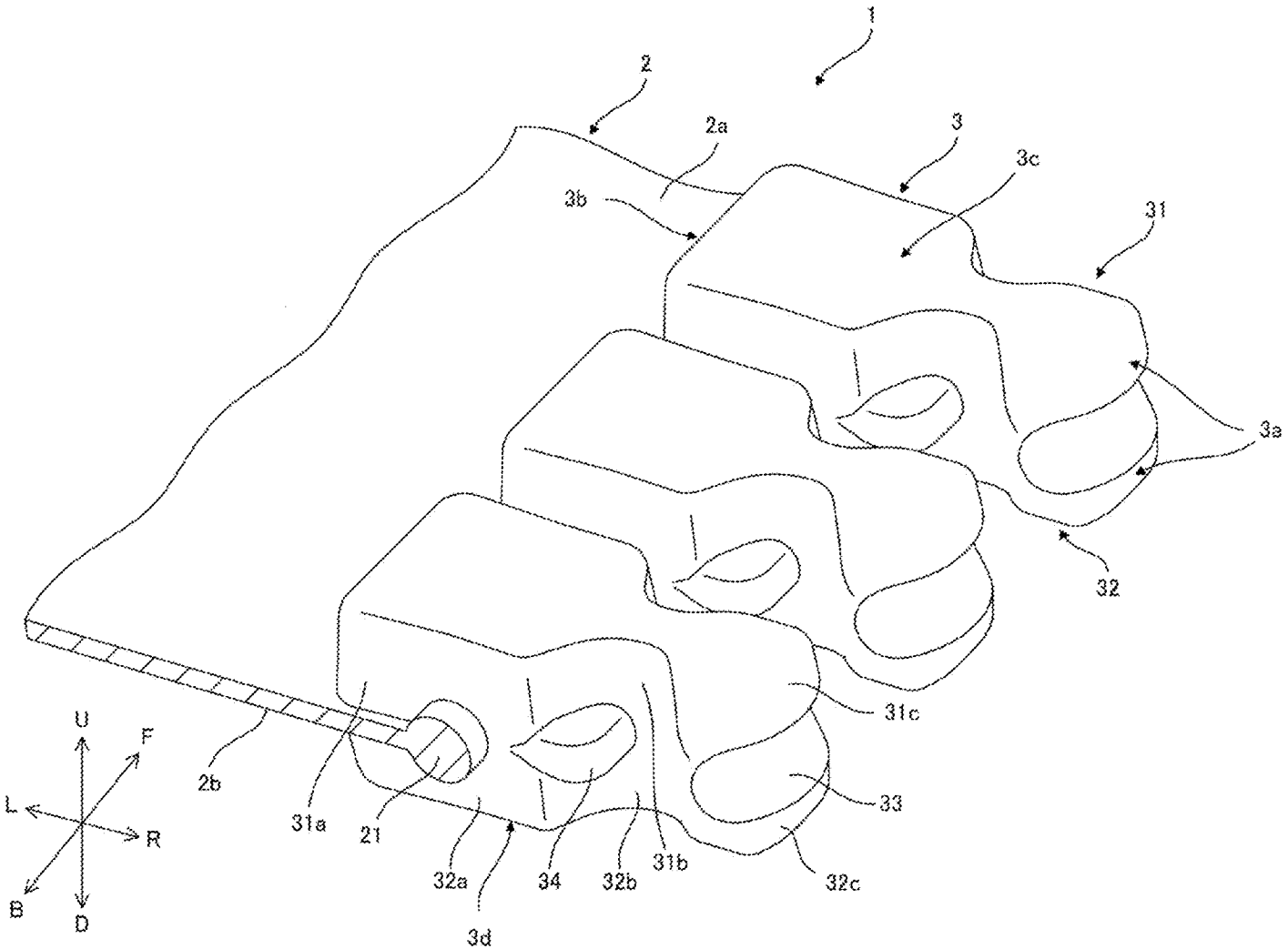
FIG. 2 is a perspective view showing a slide fastener chain according to the present embodiment.
Figure 3:
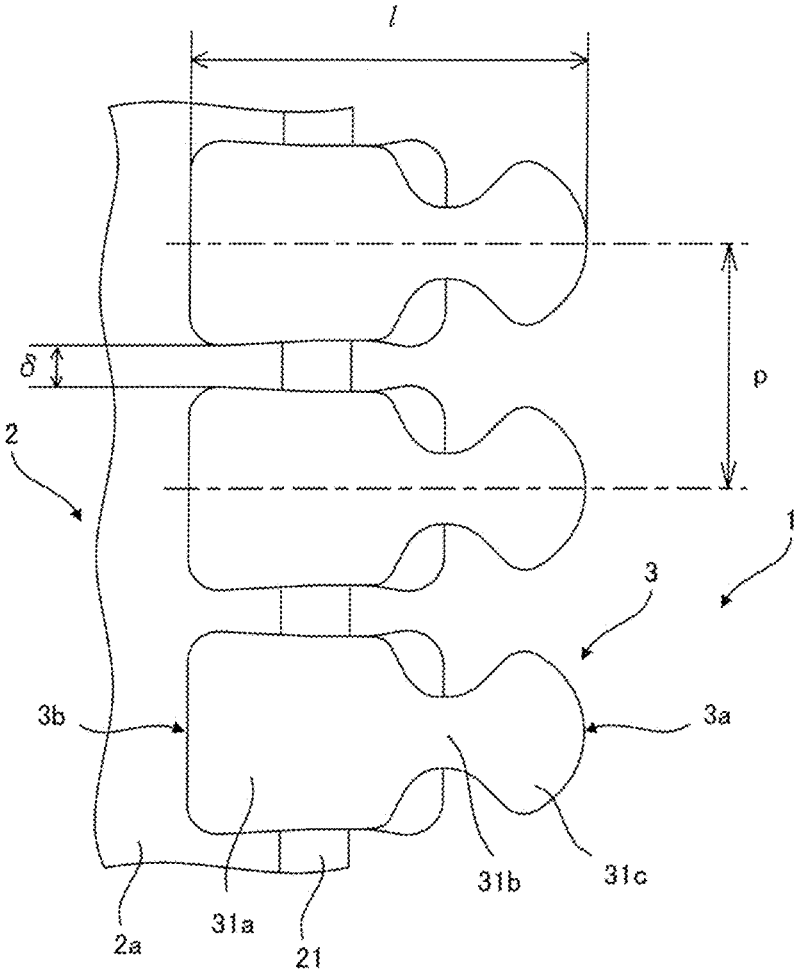
FIG. 3 is a front view showing, in a disengaged state, an element row of the slide fastener chain of the present embodiment.
Figure 4:
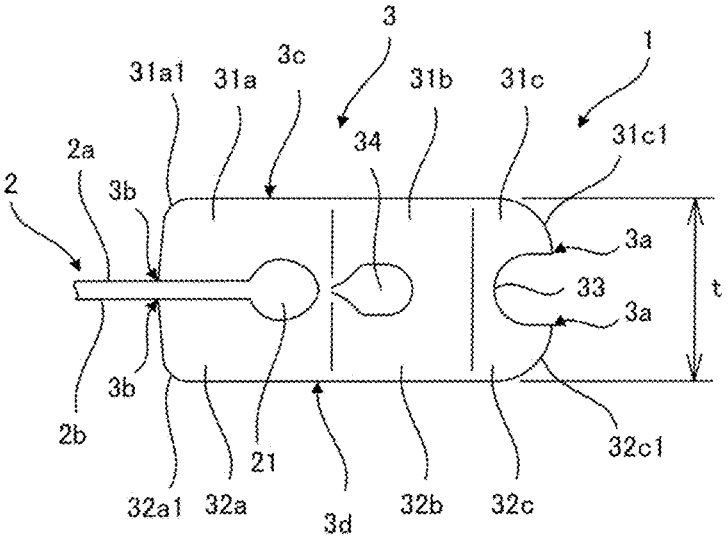
FIG. 4 is a side view showing, in the disengaged state, the element row of the slide fastener chain of the present embodiment.
Figure 5:
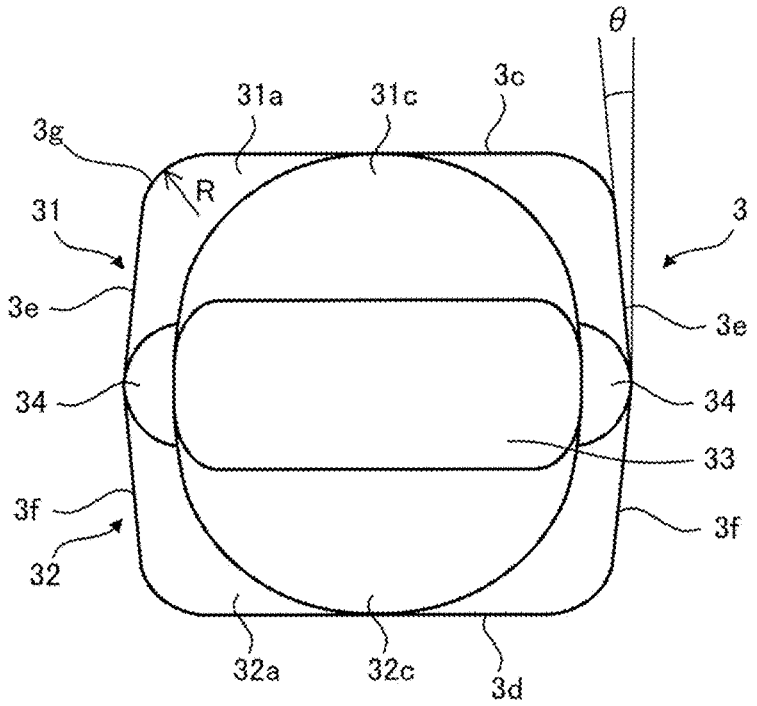
FIG. 5 is an enlarged view showing an element of the slide fastener chain according to the present embodiment, as viewed from a distal end of a head portion thereof.
Figure 6:
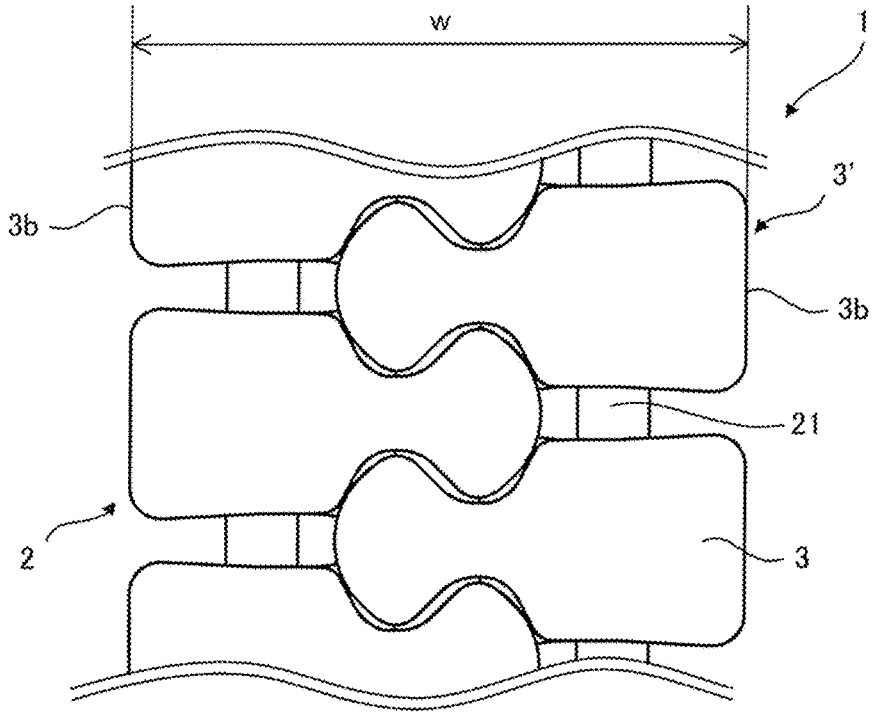
FIG. 6 is a front view showing, in an engaged state, opposing element rows of the slide fastener chain of the present embodiment.

FIG. 1 is a front view showing a slide fastener 10 according to present embodiment. FIG. 2 is a perspective view showing a slide fastener chain 1 according to the present embodiment. FIG. 3 is a front view showing, in a disengaged state, an element row of the slide fastener chain of the present embodiment. FIG. 4 is a side view showing, in the disengaged state, the element row of the slide fastener chain of the present embodiment. FIG. 5 is an enlarged view showing an element of the slide fastener chain according to the present embodiment, as viewed from a distal end of a head portion thereof. FIG. 6 is a front view showing, in an engaged state, opposing element rows of the slide fastener chain of the present embodiment.

The slide fastener 10 according to the present embodiment is constituted of a pair of fastener tapes 2 and 2, a plurality of elements 3 formed along each of opposing edge portions 21 of the fastener tapes 2 at predetermined intervals, stops 4 and 5 fixed on the edge portions 21 of the fastener tapes 2 at terminating ends of element rows 3' formed by the plurality of elements 3 and a slider 6 configured to be moved along elements 3 and thus to engage or disengage the elements 3 with or from each other. Each of element rows 3' have terminating ends in a front and rear direction of the slide fastener chain 1. Stops includes front stops 4 arranged on front ends of the element rows 3' and a rear stop 5 arranged on rear ends of the element rows 3'.

In the slide fastener chain 1 of the present embodiment according to the present invention, a length direction of the fastener tapes 2 is referred to as a front and rear direction (F-B direction) and is represented by arrows F and B. Also, a width direction of the fastener tape 2 is referred to as a right and left direction (L-R direction) and is represented by arrows L and R. Further, a front and back direction of the fastener tape 2 is referred to as an upward and downward direction (U-D direction) and is represented by arrows U and D.

The slide fastener chain 1 includes the pair of right and left fastener tapes 2, and the plurality of elements 3 made of synthetic resin and fixed on each of opposing edge portions 21 of the fastener tapes 2 at predetermined intervals in the length direction of the fastener tapes 2. In addition, the slider 6 can be moved along the elements 3 in the front and rear direction of the slide fastener chain 1 to engage or disengage the elements 3 with or from each other.

Each of fastener tapes 2 has the side portion 21 raised from upper and lower surfaces of the fastener tape 2 and also extending in the front and rear direction of the fastener tape 2. The elements 3 are integrally formed on the side portion 21 of the fastener tape 2 by injection-molding a thermoplastic synthetic resin. In the fastener tape 2, a side visible when being attached as a slide fastener on clothes, bags and the like is referred to as an upper surface 2*a* and the opposite side is referred to as a lower surface 2*b*.

Each of elements 3 has a first end located more outward than the edge portion 21 of the fastener tape 2 in the right and left direction of the slide fastener chain and a second end located more inward than the edge portion 21 of the fastener tape 2. Also, the element 3 has an upper half portion 31 arranged on the upper surface 2*a* of the fastener tape 2 and a lower half portion 32 arranged on the lower surface 2*b* of the fastener tape 2. The upper half portion 31 and the lower half portion 32 are integrally formed with each other while sandwiching the fastener tape 2 on upper and lower sides thereof.

The upper half portion 31 has an upper base portion 31*a* in contact with the upper surface 2*a* of the fastener tape 2, an upper neck portion 31*b* protruding from the upper base portion 31*a* and extending toward the outside of the fastener tape 2, and an upper head portion 31*c* formed a distal end of the upper neck portion 31*b*. The lower half portion 32 has a lower base portion 32*a* in contact with the lower surface 2*b* of the fastener tape 2, a lower neck portion 32*b* protruding from the lower base portion 32*a* and extending toward the outside of the fastener tape 2, and a lower head portion 32*c* formed a distal end of the lower neck portion 32*b*. The upper base portion 31*a* and the lower base portion 32*a* sandwich the edge portion 21 in the upward and downward direction. The first end 3*a* of the element 3 corresponds to a distal end of the upper head portion 31*c* and a distal end of the lower head portion 32*c*. The second end 3*b* of the element 3 corresponds to a distal end of the upper base portion 31*a* and a distal end of the lower base portion 32*a*.

On the upper half portion 31 of the element 3, a flat or substantially flat upper surface 3*c* is formed to extend over the upper base portion 31*a* and the upper head portion 31*c*. A portion of the upper surface 3*a*, which is close to the first end 3*a* of the upper head portion 31*c*, is an inclined surface 31*c*1 inclined downward toward the distal end of the upper head portion 31*c*. On the other hand, a portion of the upper surface 3*a*, which is close to the second end 3*b* of the upper base portion 31*a*, is an inclined surface 31*a*1 inclined downward toward the distal end of the upper base portion 31*a*. In addition, preferably, the inclined surfaces 31*c*1 and 31*a*1 are curved surfaces.

On the lower half portion 32 of the element 3, a flat or substantially flat lower surface 3*d* is formed to extend over the lower base portion 32*a* and the lower head portion 32*c*. A portion of the lower surface 3*d*, which is close to the first end 3*a* of the lower head portion 32*c*, is an inclined surface 32*c*1 inclined upward toward the distal end of the lower head portion 32*c*. On the other hand, a portion of the lower surface 3*d*, which is close to the second end 3*b* of the lower base portion 32*a*, is an inclined surface 32*a*1 inclined upward toward the distal end of the lower base portion 32*a*. In addition, preferably, the inclined surfaces 32*c*1 and 32*a*1 are curved surfaces.

A recess portion 33 opened toward the first end 3*a* is formed between the upper head portion 31*c* of the upper half portion 31 and the lower head portion 32*c* of the lower half portion 32 of the element 3. Further, a protrusion portion 34 protruding toward the first end 3*a* is formed between the upper neck portion 31*b* of the upper half portion 31 and the lower neck portion 32*b* of the lower half portion 32 of the element 3. The recess portion 33 and the protrusion portion 34 are configured so that, when the slider 6 of the slide fastener 10 is moved and thus upper neck portions 31*b* and lower neck portions 32*b* of elements 3 are respectively abutted against upper head portions 31*c* and lower head portions 32*c* of elements 3 installed to oppose thereto in the right and left direction, protrusion portions 34 are inserted into recess portions 33 opposing thereto. Thus, elements 3 opposing each other can be precisely engaged with each other.

The upper base portion 31*a* of the upper half portion 31 of each element 3 has a pair of side surfaces 3*e* arranged to be spaced from each other in the front and rear direction of the slide fastener chain 1. Each of side surfaces 3*e* is inclined to gradually approach each other as it goes from the middle of the element 3 in the upward and downward direction toward the upper surface 3*c*. Also, the lower base portion 32*a* of the lower half portion 32 of the element 3 has a pair of side surfaces 3*f* arranged to be spaced from each other in the front and rear direction of the slide fastener chain 1. Each of side surfaces 3*f* is inclined to gradually approach each other as it goes from the middle of the element 3 in the upward and downward direction toward the lower surface 3*d*. Further, chamfered portions 3*g* are formed on boundaries between the side surfaces 3*e* and the upper surface 3*c* and boundaries between the side surfaces 3*f* and the lower surface 3*d*. Each chamfered portion 3*g* has a surface curved with a radius R.

The front stops 4 are respectively arranged on front ends of the element rows 3' of the pair of fastener tapes 2. Only one rear stop 5 is arranged on the rear ends of the element rows 3' of the pair of fastener tapes 2. The rear stop 5 connects the fastener tapes 2 to prevent the fastener tapes 2 from being separated from each other as elements 3 are disengaged. Meanwhile, the rear stop 5 is not limited to the shown example. For example, the rear stop 5 may include an insertion rod fixed on the rear end of the element row of one fastener tape and a retainer fixed on the rear end of the element row of the other fastener tape and having a hole allowing the insertion rod to be inserted therein. In this case, the fastener tapes can be separated from each other as the elements are disengaged. The slider 6 can be moved between the front stops 4 and the rear stop 5 in the front and rear direction of the slide fastener chain 1.

Next, dimensions of the elements 3 will be described.

As shown in FIG. 3, the entire length l of the elements 3 of the slide fastener chain 1 is a length as measured from the first end 3*a* to the second end 3*b* of the elements 3. A pitch p of the elements 3 refers to a length as measured between center lines of adjacent elements 3 in the front and rear direction of the slide fastener chain 1. A gap δ between adjacent elements 3 in the front and rear direction of the slide fastener chain 1 refers to a minimum length dimension as measured in a gap between adjacent elements 3. As shown in FIG. 4, a thickness t of the elements 3 refers to a length as measured from a flat portion of the upper surface 3*c* to a flat portion of the lower surface 3*d* of the elements 3. As shown in FIG. 5, an inclination angle θ of the side surfaces 3*e* and 3*f* of the elements 3 refers to an angle as measured based on a straight line extending in the upward and downward direction. As shown in FIG. 6, a width w of the element rows refers to a length as measured from the second end 3*b* on one side of the opposing element rows engaged with each other to the second end 3*b* on the other side.

The slide fastener chain 1 of the present embodiment is configured so that the thickness t and pitch p of the elements 3 satisfy the following equations (1) and (2).

$$0<t\leq 2.2\text{ mm} \quad (1)$$

$$0<p\leq 3.5\text{ mm} \quad (2)$$

Also, the thickness t of the elements 3 preferably satisfies the following equation (1').

$$1.5\text{ mm}\leq t\leq 2.2\text{ mm} \quad (1')$$

Further, the thickness t of the elements 3 more preferably satisfies the following equation (1").

$$1.8\text{ mm}\leq t\leq 2.0\text{ mm} \quad (1'')$$

Also, the pitch p of the elements 3 preferably satisfies the following equation (2').

$$2.2\text{ mm}\leq p\leq 3.0\text{ mm} \quad (2')$$

Further, the pitch p of the elements 3 more preferably satisfies the following equation (2").

$$2.4\ \text{mm} \leq p \leq 2.8\ \text{mm} \quad (2")$$

Also, a dimension of the minimum gap δ between adjacent elements 3 is preferably set to 0.4 mm or more.

The thickness t of the elements 3 of the present embodiment is thinner than a thickness t of conventional elements. Because the thickness t of the elements 3 is thinner, adjacent elements 3 hardly collide against each other when the slide fastener chain 1 is bent. Thus, the slide fastener chain 1 can be easily bent. But, if the thickness t of the elements 3 is too thin, fixation strength of the elements 3 to the fastener tape 2 is decreased. Accordingly, the thickness needs to be set to have an appropriate value while ensuring a required minimum fixation strength.

Also, the pitch p of the elements 3 of the present embodiment is smaller than a pitch p of convention elements. Because the pitch p of the elements 3 is smaller, the area and number of tape portions exposed between adjacent elements per unit length of the slide fastener chain is increased. Thus, the slide fastener chain 1 can be easily bent. But, if the pitch p of the elements 3 is too small, fixation strength of the elements 3 to the fastener tape 2 is decreased. Accordingly, the pitch needs to be set to have an appropriate value while ensuring a required minimum fixation strength.

Further, the dimension of the minimum gap δ of the elements 3 in the present embodiment is smaller than a minimum gap δ of conventional elements. Setting the dimension of the minimum gap δ to be smaller is effective in setting the pitch p of the elements 3 to be smaller. But, if the dimension of the minimum gap δ is too smaller, a mold for molding the elements 3 has a thinned thickness at portions thereof for forming the gaps and is likely to be damaged. Thus, in order to prevent the mold from being damaged, the dimension of the minimum gap δ needs to be set to have an appropriate value.

A flexibility test and a bending stiffness test were performed using the elements 3 of the present embodiment as described above.

For test objects of the present embodiment, four types of elements 3 having different combinations of thickness t and pitch p are used. The four types of elements 3 were fixed on each of fastener tapes 2 having, respectively, a first double-woven structure and a second double-woven structure, and thus eight types of slide fastener chains 1 are obtained. Also, as a comparative objects, a slide fastener chain 1 in which elements which are not encompassed in the elements 3 of the present embodiment are fixed on a fastener tape 2 having a first double-woven structure is used.

Now, woven structures of the fastener tape 2 of the slide fastener chain 1 according to the present embodiment will be described.

Figure 7:
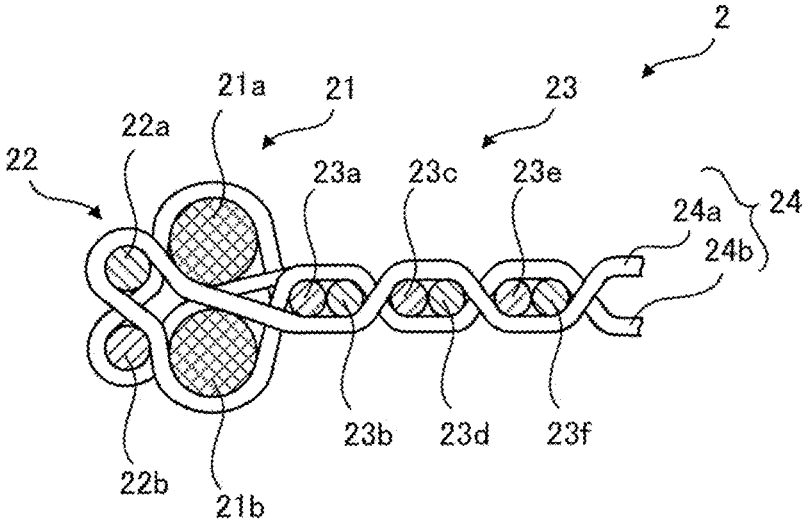
FIG. 7 is a view showing a first woven structure of a fastener tape of the slide fastener chain according to the present embodiment.

FIG. 7 is a view showing the first woven structure of the fastener tape of the slide fastener chain according to the present embodiment.

In the first woven structure of the fastener tape 2 of the present embodiment, two first warp yarns 22*a* and 22*b* arranged adjacent to the outside of core strings 21*a* and 21*b* constituting the edge portion 21 are arranged side by side in the front and back direction of the fastener tape 2. On the inside of the core strings 21*a* and 21*b*, a plurality of sets of second warp yarns 23*a* to 23*f* in which two yarns are arrayed as one set are arranged.

A first weft yarn 24*a* is weft-inserted between the plurality of sets of second warp yarns 23*a* to 23*f*, forms a looped end around the first warp yarn 22*a* on the front surface side, passes around the core string 21*b* on the back surface side, and then is weft-inserted back between the plurality of sets of second warp yarns 23*a* to 23*f*. A second weft yarn 24*b* is weft-inserted between the plurality of sets of second warp yarns 23*a* to 23*f*, forms a looped end around the first warp yarn 22*b* on the back surface-side end, passes around the core string 21*a* on the front surface side, and then is weft-inserted back between the plurality of sets of second warp yarns 23*a* to 23*f*.

Figure 8:
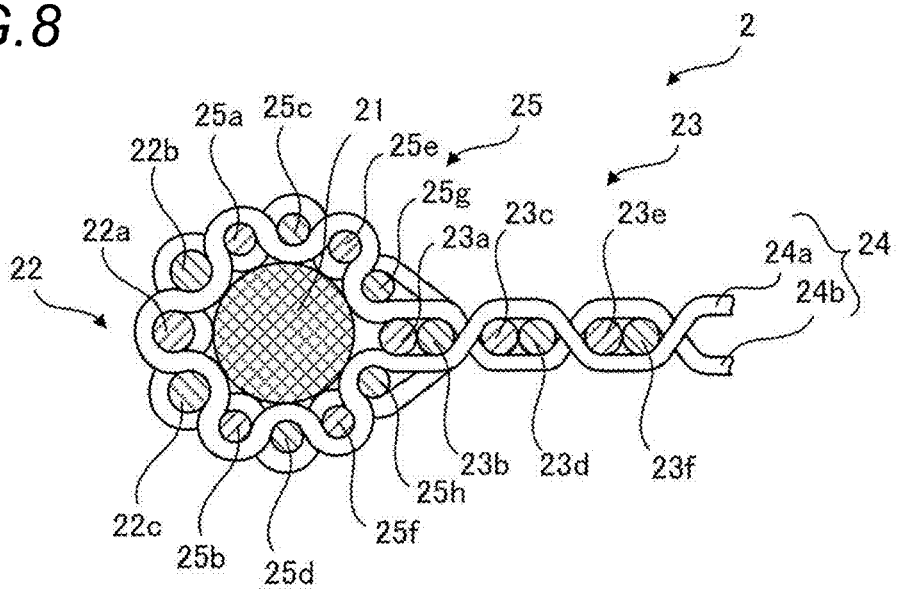
FIG. 8 is a view showing a second woven structure of the fastener tape of the slide fastener chain according to the present embodiment.

FIG. 8 is a view showing the second woven structure of the fastener tape of the slide fastener chain according to the present embodiment.

In the second woven structure of the fastener tape 2 of the present embodiment, three first warp yarns 22*a* to 22*c* arranged adjacent to the outside of a core string 21 constituting the edge portion 21 are arranged side by side in the front and back direction of the fastener tape 2. On the inside of the core string 21, a plurality of sets of second warp yarns 23*a* to 23*f* in which two yarns are arrayed as one set are arranged. Third warp yarns 25*a* to 25*h* are arranged around the core string 21 between the first warp yarns 22*a* to 22*c* and the second warp yarns 23*a* to 23*f*.

A first weft yarn 24*a* is weft-inserted between the plurality of sets of second warp yarns 23*a* to 23*f*, is weft-inserted between the third warp yarns 25*h*, 25*f*, 25*d* and 25*b* and then passes around the first warp yarns 22*c*, 22*a* and 22*b*. Subsequently, the first weft yarn 24*a* is weft-inserted between the third warp yarns 25*a*, 25*c*, 25*e* and 25*g* and then is weft-inserted back between the plurality of sets of second warp yarns 23*a* to 23*f*. A second weft yarn 24*b* is weft-inserted between the plurality of sets of second warp yarns 23*a* to 23*f*, is weft-inserted between the third warp yarns 25*g*, 25*e*, 25*c* and 25*a* and then passes around the first warp yarns 22*b*, 22*a* and 22*c*. Subsequently, the second weft yarn 24*b* is weft-inserted between the third warp yarns 25*b*, 25*d*, 25*f* and 25*h* and then is weft-inserted back between the plurality of sets of second warp yarns 23*a* to 23*f*.

Next, dimensions of the elements 3 of the present embodiment used in the tests will be described. Thicknesses t and pitches p of elements 3 of the test objects and the comparative object are shown in the following Table 1. Herein, the unit is mm.

TABLE 1

| Test objects (First double-woven) | | | | |
|---|---|---|---|---|
| | Sample 1 | Sample 2 | Sample 3 | Sample 4 |
| Thickness t | 1.8 | 1.8 | 2.0 | 1.8 |
| Pitch p | 2.4 | 2.8 | 2.8 | 3.5 |
| **Test objects (Second double-woven)** | | | | |
| | Sample 5 | Sample 6 | Sample 7 | Sample 8 |
| Thickness t | 1.8 | 1.8 | 2.0 | 1.8 |
| Pitch p | 2.4 | 2.8 | 2.8 | 3.5 |
| **Comparative object (First double-woven)** | | | | |
| | | | Sample 9 | |
| Thickness t | | | 2.6 | |
| Pitch p | | | 3.5 | |

Also, the test objects of the present embodiment were configured so that the inclination angle θ of the side surfaces 3*e* and 3*f* of the elements 3 as shown in FIG. 5 is 5° and the radius R of the chamfered portions 3*g* is 0.25 mm. Contrarily, the comparative object was configured so that an inclination angle θ of inclined portions 3*e* and 3*f* of the elements 3 is 10° and a radius R of chamfered portions 3*g* is 0.3 mm In addition, a width w of element rows 3' in a state where the element rows 3' are engaged with each other as shown in FIG. 6 was set to 5.7 mm in all of the test objects of the present embodiment and the comparative object.

Next, the flexibility test will be described.

Figure 9:
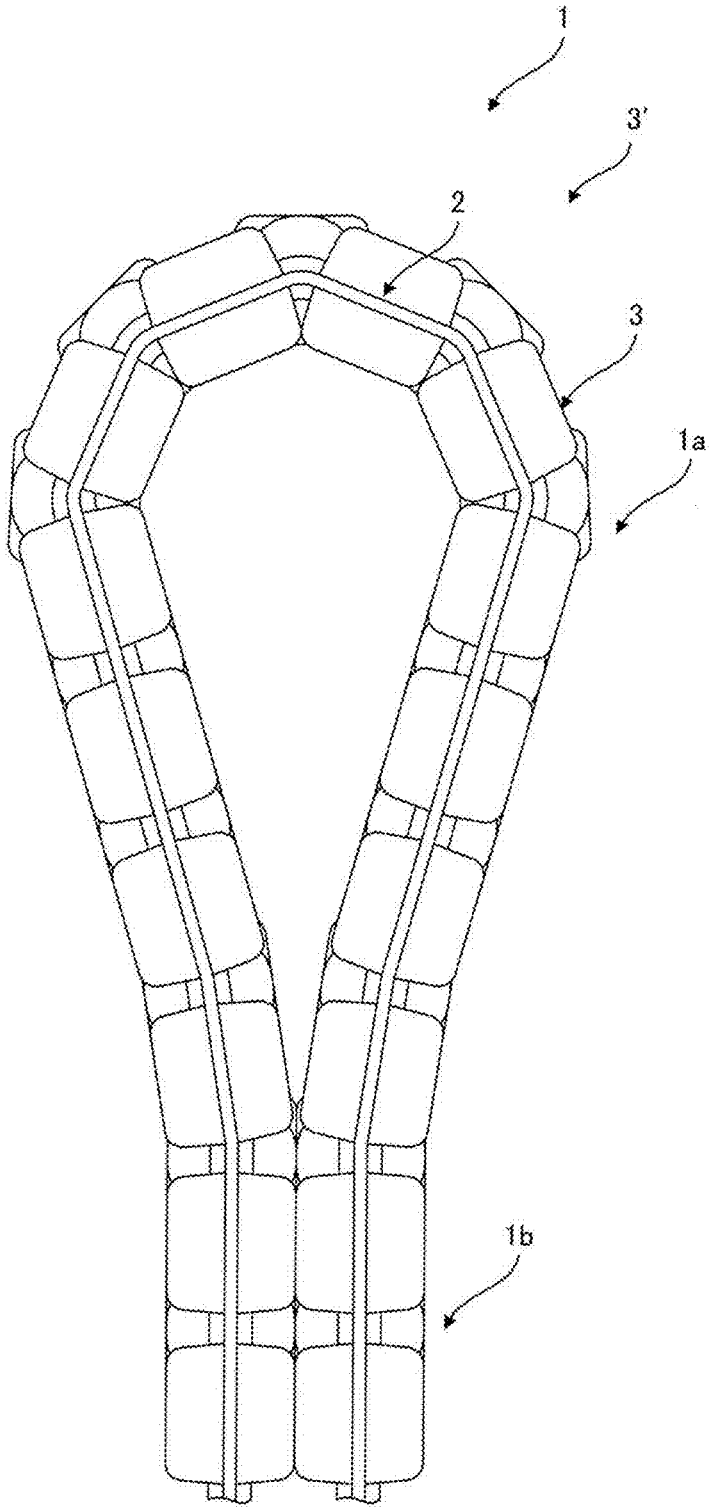
FIG. 9 is a view showing the slide fastener chain according to the present embodiment in a state where the slide fastener chain is bent into a loop shape.
Figure 10:
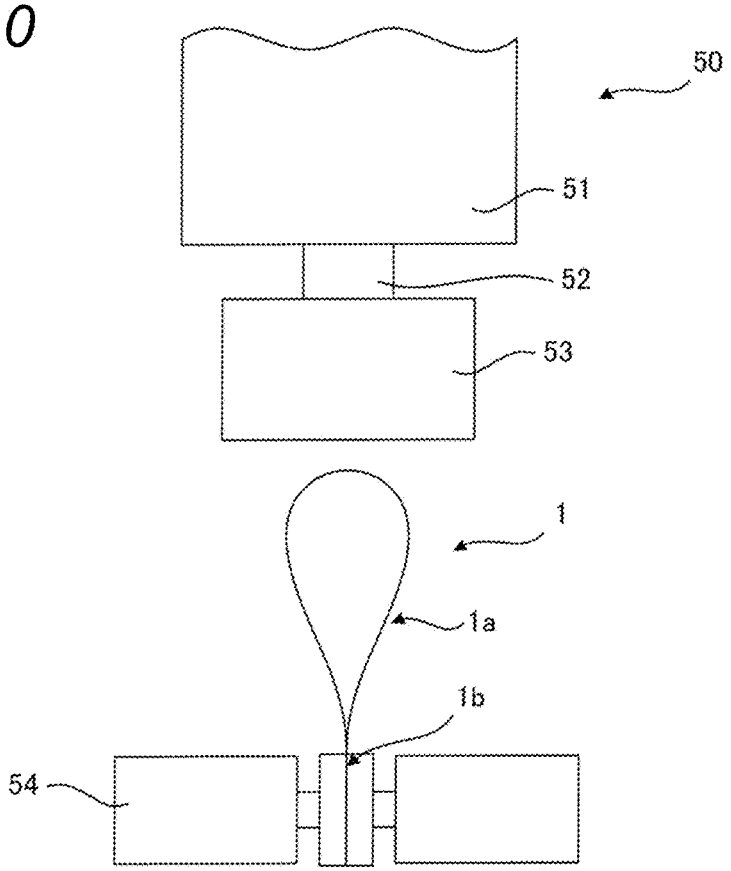
FIG. 10 is a view showing a flexibility testing device in a state prior to operation thereof.
Figure 11:
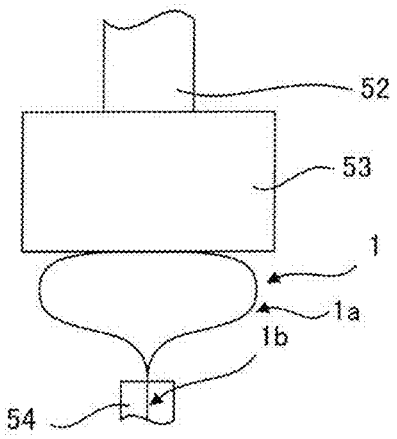
FIG. 11 is a view showing the flexibility testing device in a state during operation thereof.

FIG. 9 is a view showing the slide fastener chain according to the present embodiment in a state where the slide fastener chain is bent into a loop shape. FIG. 10 is a view showing a flexibility testing device in a state prior to operation thereof. FIG. 11 is a view showing the flexibility testing device in a state during operation thereof.

First, slide fastener chains 1 of 120 mm or more using elements 3 of each sample shown in Table 1 are manufactured. The elements 3 were in an engaged state. As shown in FIG. 9, the slide fastener chains 1 are prepared to form a loop portion 1*a* by being bent at the vicinity of the middle in the length direction and also to form an overlap portion 1*b* at both ends. A length of the loop portion 1*a* is set to 80 mm and a length of the overlap portion 1*b* is set to 20 mm or more. The overlap portion 1*b* is preferably fastened by a tape or the like.

As shown in FIG. 10, the flexibility testing device 50 used in the flexibility test has a movable member 51 configured to be moved up and down, a load cell 52 attached on the movable member 51 and configured to convert a load to an electrical signal, a pressurizer 53 attached on the load cell 52 and configured to press the loop portion 1*a* of the slide fastener chains 1, and a clamp 54 for fixing the overlap portion 1*b* of the slide fastener chains 1.

The clamp 54 supports the slide fastener chains 1 in a state where the loop portion 1*a* protrudes upward therefrom and the overlap portion 1*b* is sandwiched therebetween. In this state, the movable member 51 is moved downward. As the movable member 51 is moved downward, the load cell 52 and the pressurizer 53 are also moved downward. Then, as shown in FIG. 11, the pressurizer 53 presses the loop portion 1*a*. After the movable member 51 is moved downward to a predetermined position, a tester determines a maximum load within the moving range by means of the load cell 52.

Table 2 shows the results of test performed on each of the test objects and comparative object. As shown in Table 2, the flexibility test was performed five times for each of Samples 1 to 8 of the test objects and three times for Sample 9 of the comparative object, and then a maximum value (max), a minimum value (min) and an average value (Ave) were obtained for each sample.

TABLE 2

| | Sample 1 | Sample 2 | Sample 3 | Sample 4 | Sample 5 | Sample 6 | Sample 7 | Sample 8 | Sample 9 |
|---|---|---|---|---|---|---|---|---|---|
| 1st time | 2.3 | 3.7 | 3.6 | 5.5 | 1.1 | 2.4 | 2.4 | 3.7 | 17.2 |
| 2nd time | 2.3 | 3.9 | 3.2 | 6.0 | 1.2 | 2.3 | 2.1 | 4.4 | 17.3 |
| 3rd time | 2.3 | 4.0 | 3.4 | 5.8 | 1.3 | 2.5 | 2.5 | 4.2 | 15.9 |
| 4th time | 2.4 | 3.6 | 3.6 | 5.4 | 1.2 | 2.2 | 2.3 | 4.0 | — |
| 5th time | 2.5 | 3.8 | 3.3 | 5.9 | 1.2 | 2.7 | 2.2 | 3.8 | — |
| Ave | 2.3 | 3.8 | 3.4 | 5.7 | 1.2 | 2.4 | 2.3 | 4.0 | 16.8 |
| max | 2.5 | 4.0 | 3.6 | 6.0 | 1.3 | 2.7 | 2.5 | 4.4 | 17.3 |
| min | 2.3 | 3.6 | 3.2 | 5.4 | 1.1 | 2.2 | 2.1 | 3.7 | 15.9 |

Figure 12:
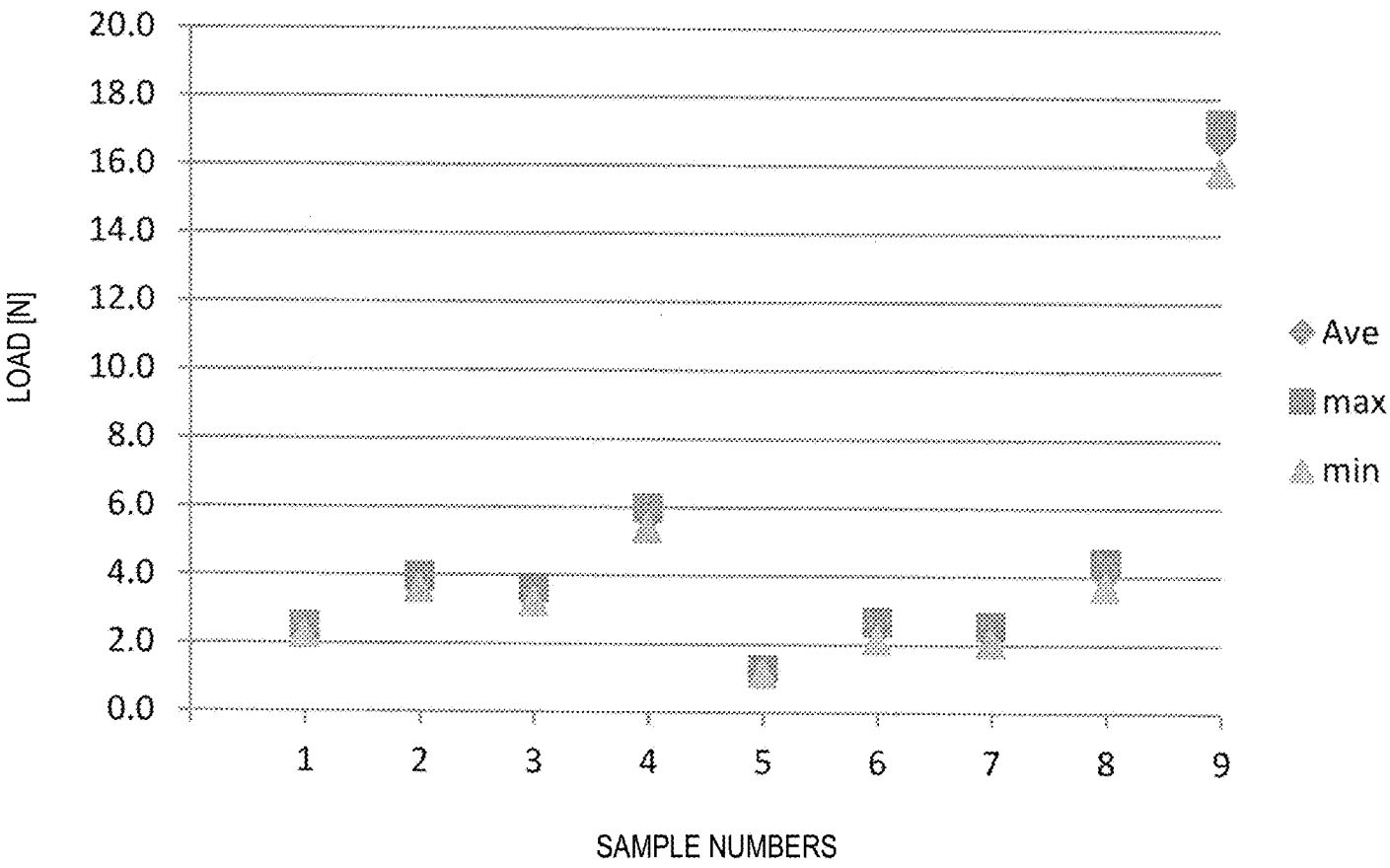
FIG. 12 is a graph showing a maximum value (max), a minimum value (min) and an average value (Ave) of each sample of the slide fastener chain according to the present embodiment.

FIG. 12 is a graph showing the maximum value (max), the minimum value (min) and the average value (Ave) of each sample of the slide fastener chains of the present embodiment.

As shown in FIG. 12, Samples 1 to 8 of the slide fastener chains of the test objects, which have elements 3 satisfying dimensions of the present embodiment, have the maximum loads within the moving range lower than that of Sample 9 of the slide fastener chain of the comparative object, which has elements 3 not satisfying the dimensions of the present embodiment. In other words, the slide fastener chains of the test objects, which have elements 3 satisfying dimensions of the present embodiment, have an excellent flexibility.

Specifically, the slide fastener chains 1 of the present embodiment have the maximum load F within the moving range in the flexibility test satisfying the following equation (3).

$$0<F\leq 6.5\ \text{N} \tag{3}$$

Also, it is preferable that the maximum load F within the moving range satisfies the following equation (3').

$$0.8\ \text{N}\leq F\leq 4.0\ \text{N} \tag{3'}$$

Further, it is more preferable that the maximum load F within the moving range satisfies the following equation (3").

$$2.0\ \text{N}\leq F\leq 2.5\ \text{N} \tag{3''}$$

Also, the test objects of the present embodiment are configured so that the inclination angle θ of the side surfaces 3*e* and 3*f* and the radius R of the chamfered portions 3*g* of the elements 3 are smaller than those of the comparative object. Typically, if elements 3 have the same thickness t and pitch p, a slide fastener chain 1 in which an inclination angle of inclined portions 3*e* and 3*f* and a radius of chamfered portions 3*g* are larger has an extended moving distance until adjacent elements 3 thereof come in contact with each other and thus has an excellent flexibility. However, the elements 3 of the present embodiment have reduced thickness t and pitch p, thereby allowing the inclination angle of the inclined portions 3*e* and 3*f* and the radius of the chamfered portions 3*g* to be reduced.

Next, the bending stiffness test will be described.

Figure 13:
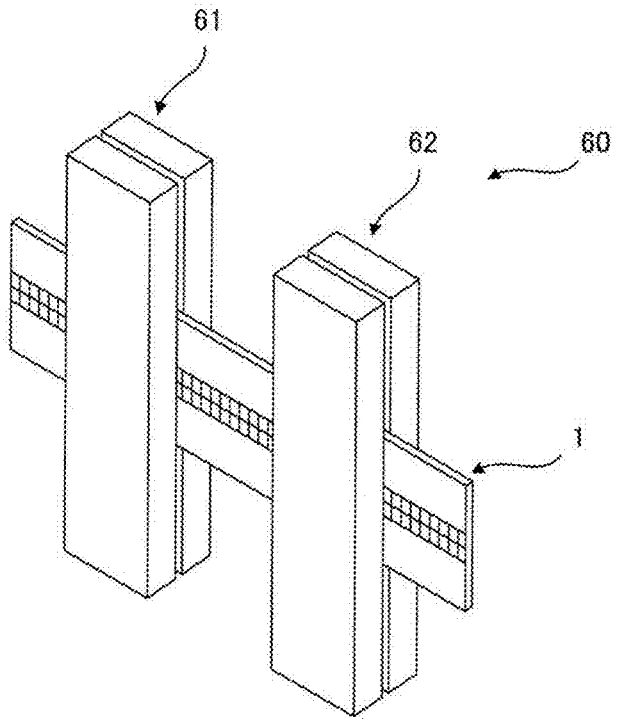
FIG. 13 is a view showing a bending stiffness testing device in a state prior to operation thereof.
Figure 14:
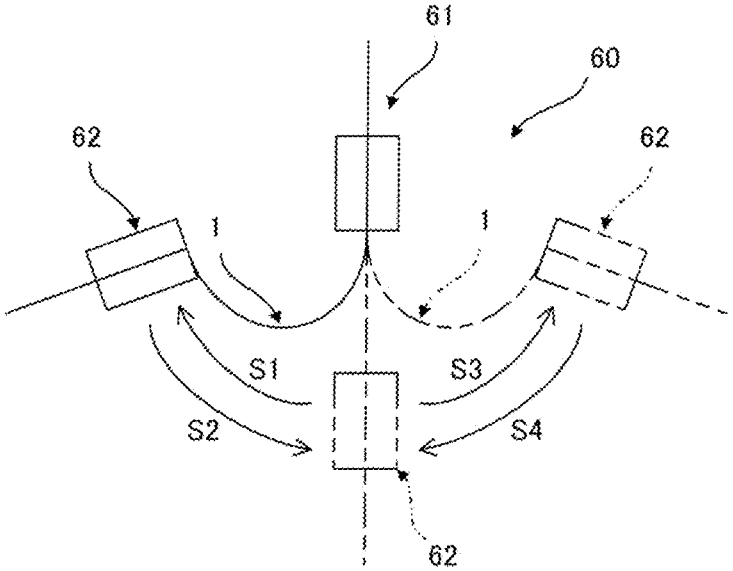
FIG. 14 is a view showing the bending stiffness testing device in a state during operation thereof.
Figure 15:
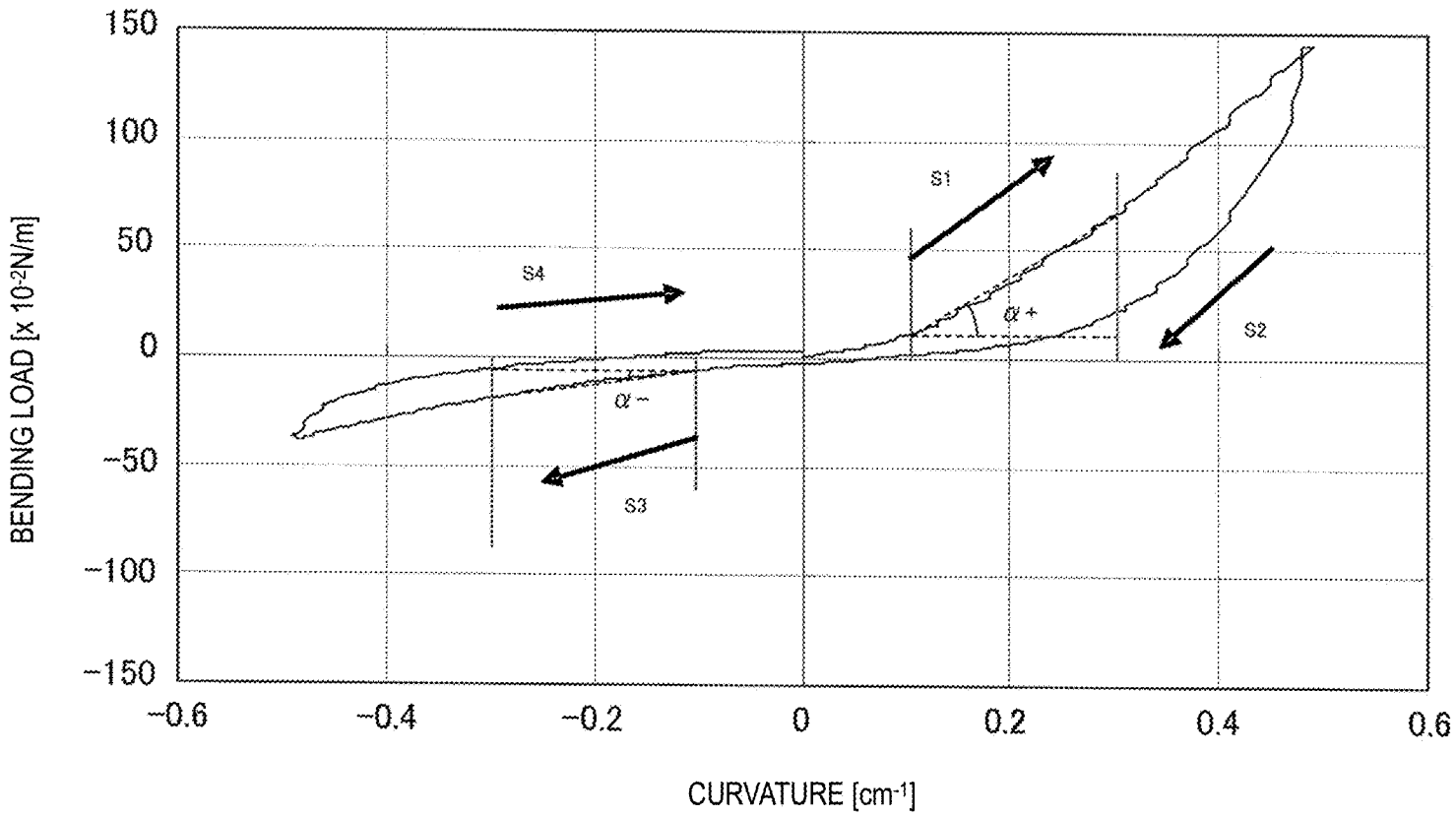
FIG. 15 is a graph showing a bending load as a function of a curvature in the slide fastener chain according to the present embodiment.

FIG. 13 is a view showing a bending stiffness testing device in a state prior to operation thereof. FIG. 14 is a view showing the bending stiffness testing device in a state during operation thereof. FIG. 15 is a graph showing a bending load as a function of a curvature in the slide fastener chains according to the present embodiment.

As shown in FIG. 13, the bending stiffness testing device 60 used in the bending stiffness test has a fixed portion 61 for sandwiching one end of slide fastener chains 1 in the length direction and a movable portion 62 for sandwiching the other end of the slide fastener chains 1. As the bending stiffness testing device 60, a pure bending testing machine (KES-FB-2) produced by Kato Tech Co., Ltd. was employed.

First, slide fastener chains 1 of 100 mm using elements 3 of each sample shown in Table 1 are manufactured. Then, slide fastener chains 1 are installed so that a distance between the fixed portion 61 and the movable portion 62 is 40 mm. Subsequently, as shown in FIG. 14, the moveable 62 is rotated about the fixed portion 61 with a uniform velocity as in steps 1 to 4. Then, the slide fastener chain 1 is curved between the fixed portion 61 and the movable portion 62.

In the bending stiffness test, a bending load as a function of a curvature at that time is measured. As shown in FIG. 15, a value of a bending stiffness was defined as α which is an average value of an inclination (α+) in a curvature of between 0.5 and 1.5 and an inclination (α−) in the curvature of between −0.5 and −1.5.

Table 3 shows the results of test performed on each of the test objects and comparative object. As shown in Table 3, the bending stiffness test was performed on three states, i.e., a state where elements of the slide fastener chain 1 are engaged with each other, a state where elements of the slide fastener chain 1 are not engaged with each other, and a state where only a tape is used. These states are respectively represented as "Engaged chain", "Non-engaged chain" and "Tape" in FIG. 16. By performing the test on each state, an average value of a bending stiffness α for each was obtained.

TABLE 3

| | Engaged Chains | | | Non-Engaged Chains | | | Tape | | |
|---|---|---|---|---|---|---|---|---|---|
| | min | max | Ave | min | max | Ave | min | max | Ave |
| Sample 1 | 21.2 | 37.3 | 27.3 | 15.3 | 30.6 | 24.9 | 3.8 | 9.6 | 6.1 |
| Sample 2 | 26.8 | 38.3 | 35.6 | 15.3 | 34.5 | 24.9 | 3.8 | 9.6 | 6.1 |
| Sample 3 | 28.7 | 34.5 | 32.1 | 23.0 | 30.6 | 26.8 | 3.8 | 9.6 | 6.1 |
| Sample 4 | 38.3 | 55.5 | 47.6 | 24.9 | 40.2 | 32.6 | 3.8 | 9.6 | 6.1 |
| Sample 5 | 6.7 | 13.4 | 9.3 | 5.7 | 11.5 | 8.9 | 1.9 | 3.8 | 3.5 |
| Sample 6 | 9.6 | 16.3 | 13.6 | 5.7 | 15.3 | 11.2 | 1.9 | 3.8 | 3.5 |
| Sample 7 | 8.6 | 16.3 | 12.9 | 5.7 | 9.6 | 8.1 | 1.9 | 3.8 | 3.5 |
| Sample 8 | 12.4 | 22.0 | 17.2 | 9.6 | 15.3 | 12.4 | 1.9 | 3.8 | 3.5 |
| Sample 9 | 72.8 | 114.9 | 96.4 | 61.3 | 114.9 | 83.9 | 3.8 | 9.6 | 6.1 |

Figure 16:
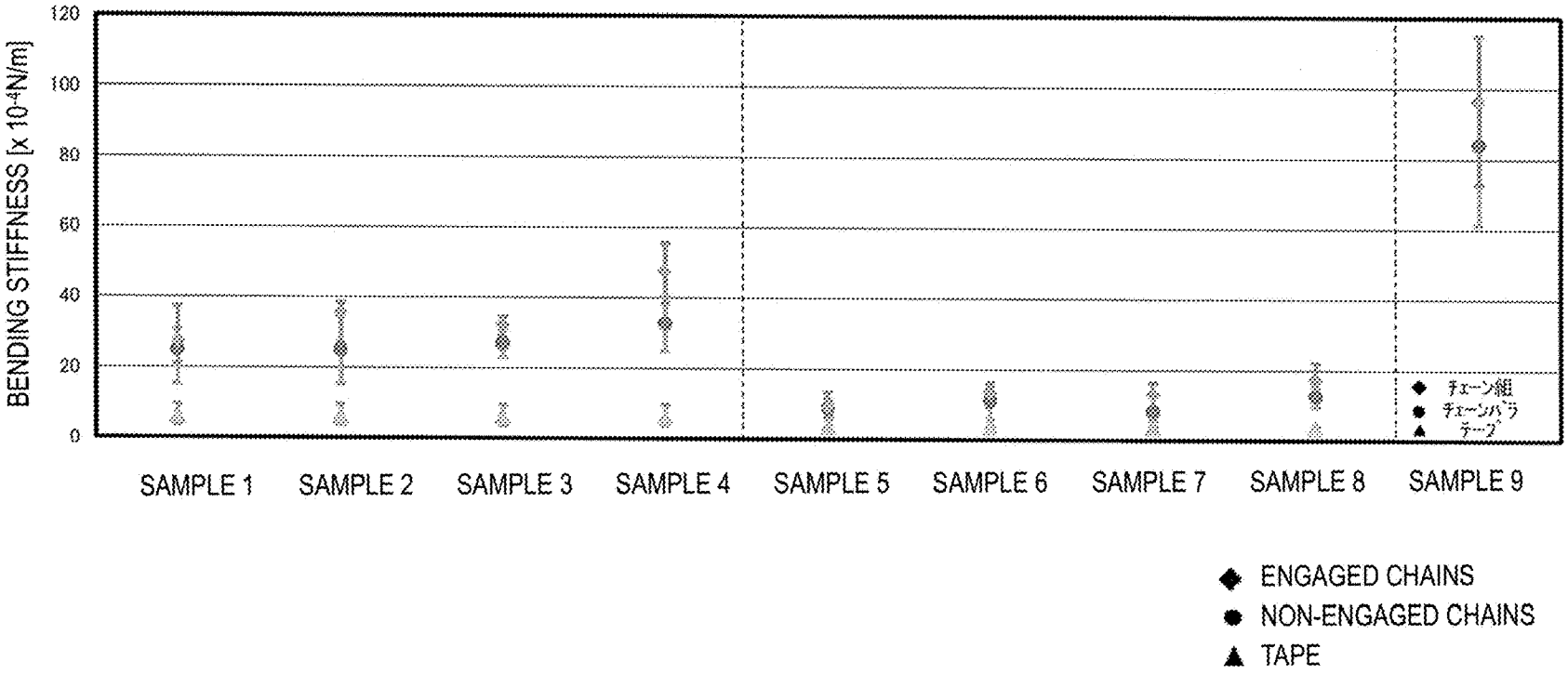
FIG. 16 is a graph shown a bending stiffness of each sample of the slide fastener chain according to the present embodiment.

FIG. 16 is a graph shown a bending strength of each sample of the slide fastener chains according to the present embodiment.

As shown in FIG. 16, bending stiffnesses of the slide fastener chains 1 of Samples 1 to 8 are smaller than a bending stiffness of the slide fastener chain 1 of Sample 9. Namely, the slide fastener chains 1 of Samples 1 to 8 can be more easily bent than the slide fastener chain 1 of Sample 9.

Specifically, the slide fastener chains 1 of the present embodiment have the bending stiffnesses α within a moving range in the bending stiffness test satisfying the following equation (4).

$$0<\alpha\leq 60\times 10^{-4}\ \text{Nm/m} \quad (4)$$

Also, it is preferable that the bending stiffness α within the moving range in the bending stiffness test satisfies the following equation (4').

$$0<\alpha\leq 40\times 10^{-4}\ \text{Nm/m} \quad (4')$$

Also, it is more preferable that the bending stiffness α within the moving range in the bending stiffness test satisfies the following equation (4").

$$0<\alpha\leq 20\times 10^{-4}\ \text{Nm/m} \quad (4'')$$

Meanwhile, in the slide fastener chain 1 in the engaged state, the number of elements per one pitch (p) is two. Specifically, for adjacent elements 3 fixed on one fastener tape 2, a half portion of an element 3 arranged on the front side of the slide fastener chain 1, which is arranged rearward relative to the center line thereof as a boundary, and a half portion of an element 3 arranged on the rear side of the slide fastener chain 1, which is arranged forward relative to the center line thereof as a boundary, are counted as one element. Also, an element 3 fixed on the other fastener tape 2 and engaged with the half portions is counted as one element. The number of elements per a predetermined length (L) of the slide fastener chain 1 is calculated by 2 L/p. On the basis of this equation and assuming that the length (L) is 10 mm, the number of elements of the slide fastener chain 1 of the present embodiment preferably satisfies the following equation (5).

$$5\ \text{elements}<2\ L/p\leq 9\ \text{elements} \quad (5)$$

Next, a ratio between thickness dimensions of the element 3 will be described.

Figure 17:
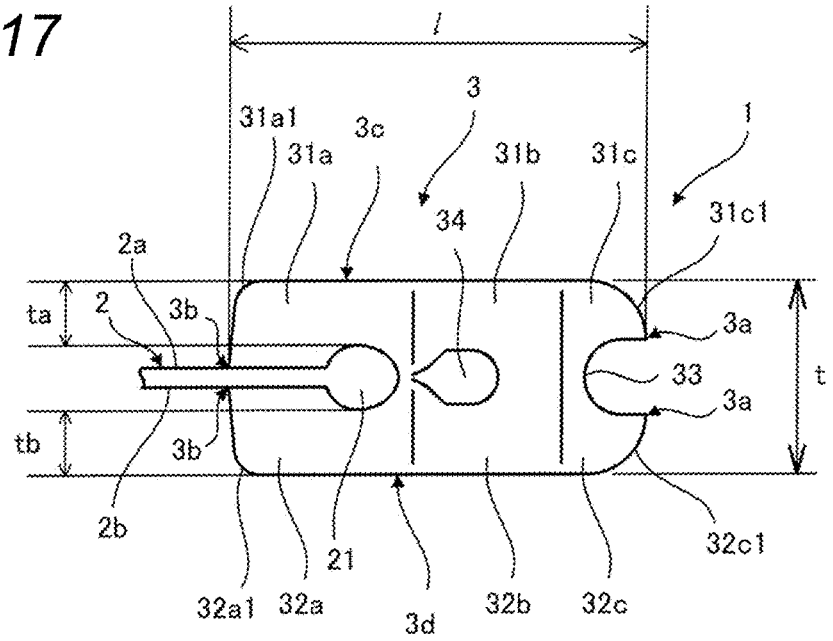
FIG. 17 is a side view showing the element rows of the slide fastener chain according to the present embodiment in a disengaged state.

FIG. 17 is a side view showing the element rows of the slide fastener chain according to the present embodiment in a disengaged state.

As shown in FIG. 17, where a first partial thickness as measured from the upper surface 3*c* of the element 3 to an upper surface-side apex 211 of the edge portion 21 is to and a second partial thickness as measured from the lower surface 3*d* of the element 3 to an lower surface-side apex 212 of the edge portion 21 is tb, the element 3 of the slide fastener chain 1 of the present embodiment is preferably configured so that a ratio Rt of the sum dimension of the first partial thickness ta and the second partial thickness tb to the thickness t satisfies the following equation (6).

$$40\%\leq Rt \quad (6)$$

where Rt=(ta+tb)/t×100.

More preferably, the ratio Rt satisfies the following equation (6').

$$45\%\leq Rt \quad (6')$$

For example, in a case of a thinner thickness t, if the first partial thickness ta and the second partial thickness tb are too thin, there is a possibility that when a lateral pulling force is exerted on the fastener in an engaged state, a fracture is initiated from portions having the first partial thickness ta and the second partial thickness tb and the fastener is damaged.

Thus, it is preferable that the ratio Rt of the sum dimension of the first partial thickness ta and the second partial thickness tb to the thickness t satisfies the equation (6) or (6') so that a necessary and sufficient strength is given to the element 3.

Figure 18:
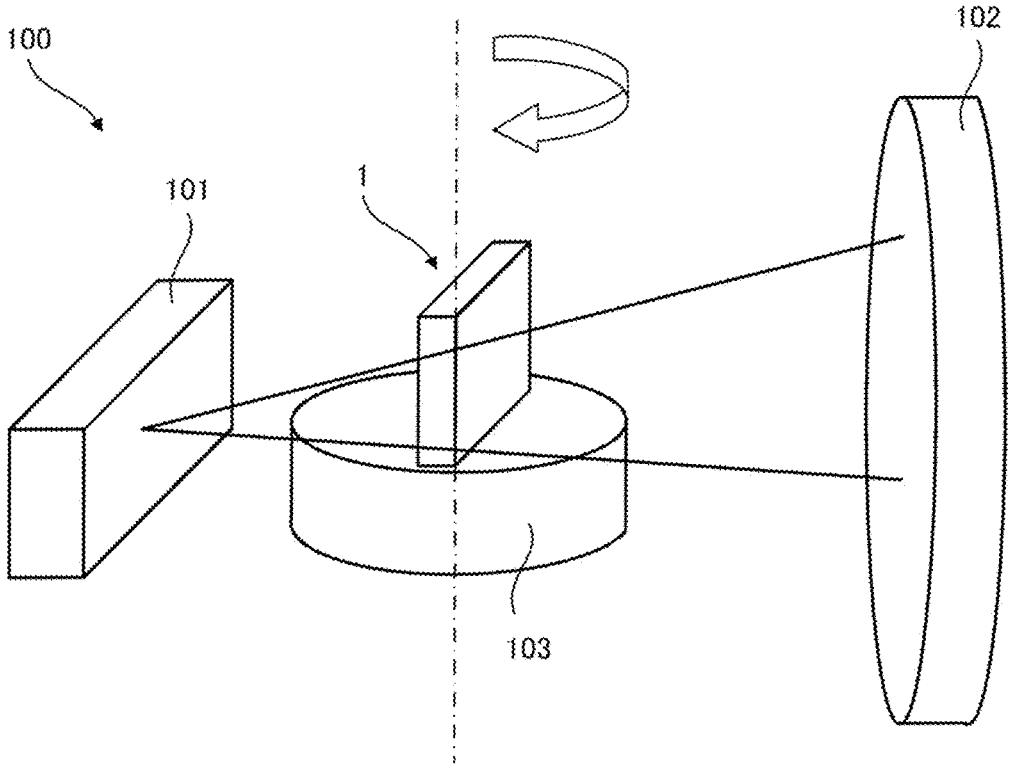
FIG. 18 is shows a method for measuring a first partial thickness and a second partial thickness.
Figure 19:
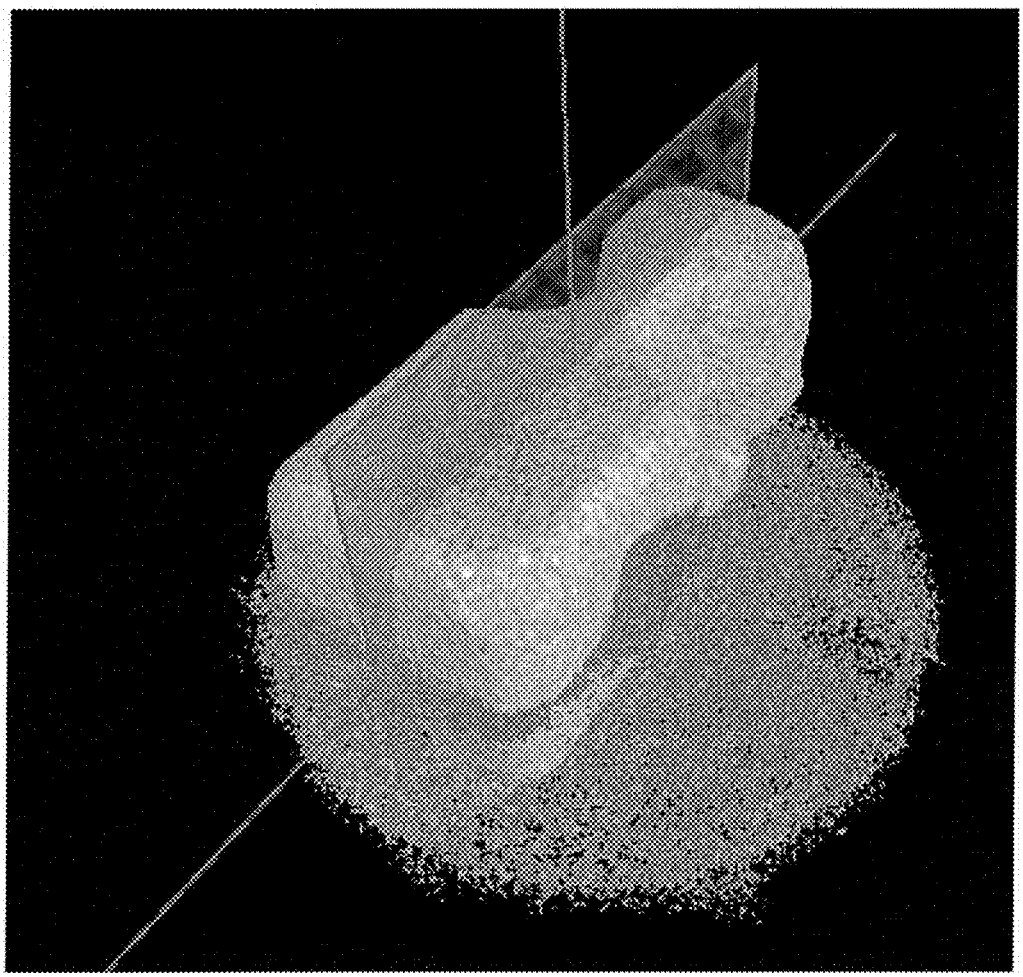
FIG. 19 is shows a pictured cross-sectional image of the element.

FIG. 18 shows a method for measuring the first partial thickness and the second partial thickness. FIG. 19 shows the entire image of the element obtained from imaging data.

In the present embodiment, a cross-sectional image of the element 3 of the slide fastener chain 1 is first pictured using a micro focus X-ray fluoroscopic/CT apparatus 100 ("SMX225CT" produced by Shimadzu Corporation). As shown in FIG. 18, the micro focus X-ray fluoroscopic/CT apparatus 100 has a X-ray tube 101 for emitting X-ray, a X-ray detector 102 for detecting X-ray and a rotatable table 103 for placing and rotating a subject to be measured thereon. In the present embodiment, as shown in FIG. 19, the element 3 was placed on the rotatable table 103 and then the first partial thickness ta and the second partial thickness tb were measured on a cross section taken along the center line of the element 3.

Measurement conditions of the micro focus X-ray fluoroscopic/CT apparatus 100 are as follows.

SID: 600 mm (a distance from the X-ray tube 101 to the X-ray detector 102)

SOD: 22.8 mm (a distance from the X-ray tube 101 to the center of the rotatable table 103)

VOXEL SIZE: 0.012 mm

Voltage of the X-ray tube 101: 90 kV

Current of the X-ray tube 101: 40 μA

The number of views: 1200

The average number: 10

Sliced thickness: 0.013 mm

Image size: 512×512

Figure 20:
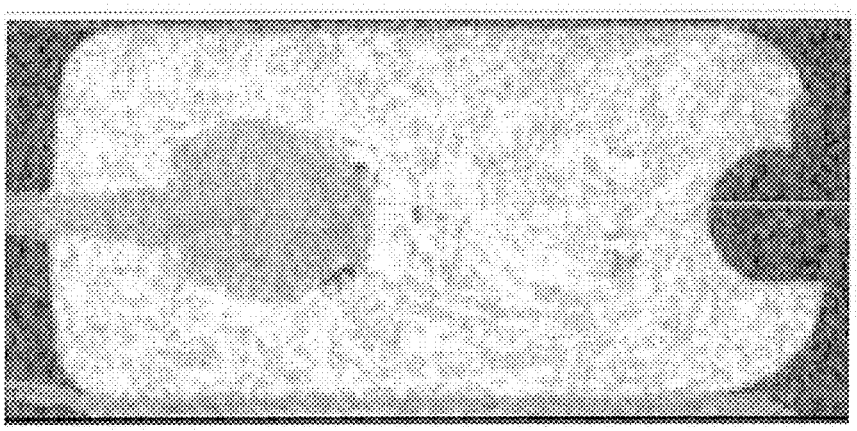
FIG. 20 is shows a cross-sectional image taken along the center line of the element.
Figure 21:
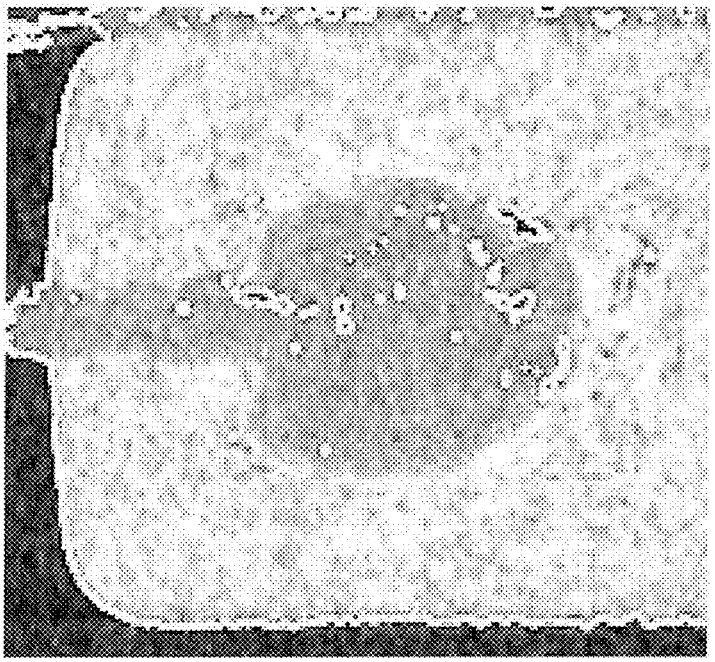
FIG. 21 is shows an enlarged view of the vicinity of the edge portion in FIG. 20.

FIG. 20 shows a cross-sectional image taken along the center line of the element. FIG. 21 shows an enlarged view of the vicinity of the edge portion 21.

In the present embodiment, as shown in FIGS. 20 and 21, the micro focus X-ray fluoroscopic/CT apparatus 100 is adjusted in contrast so that a boundary between the edge portion 21 and the element 3 becomes clear. Thus, the first partial thickness ta and the second partial thickness tb on the cross section taken along the center line of the element 3 can be precisely measured.

Hereinafter, a relationship between measured results and lateral pulling strengths in samples of the element 3 will be described.

Sample A

Thickness t=1.8 mm, first partial thickness ta=0.43 mm and second partial thickness tb=0.43 mm The ratio Rt of the sum dimension of the first partial thickness ta and the second partial thickness tb to the thickness t is $$(ta+tb)/1.8\times100=47.7\%$$

Sample B

Thickness t=1.8 mm, first partial thickness ta=0.58 mm and second partial thickness tb=0.40 mm The ratio Rt of the sum dimension of the first partial thickness ta and the second partial thickness tb to the thickness t is $$(ta+tb)/1.8\times100=54.4\%$$

Sample C

Thickness t=1.8 mm, first partial thickness ta=0.42 mm and second partial thickness tb=0.47 mm The ratio Rt of the sum dimension of the first partial thickness ta and the second partial thickness tb to the thickness t is $$(ta+tb)/1.8\times100=49.4\%$$

Sample D

Thickness t=1.8 mm, first partial thickness ta=0.35 and second partial thickness tb=0.43

The ratio Rt of the sum dimension of the first partial thickness ta and the second partial thickness tb to the thickness t is $$(ta+tb)/1.8\times100=43.3\%$$

TABLE 4

| Sample | Lateral Pulling Strength |
|---|---|
| A | Good |
| B | Very Good |
| C | Good |
| D | Normal |

Sample B having the largest Rt has a sufficient strength to such an extent that an average strength in a lateral pulling strength test of a fastener chain (JISS3015) exceeds 380 N. Contrarily, as Rt is decreased, the average strength is also decreased, and Sample D has barely a utilizable strength. Thus, it is found that if Rt is below 40%, this is not preferable.

As described above, the element 3 of the slide fastener chain 1 according to the present embodiment is configured so that the ratio Rt of the sum dimension of the first partial thickness to and the second partial thickness tb to the thickness t is set to 40% or more. Accordingly, a slide fastener chain having a necessary and sufficient strength can be provided.

Next, a ratio between length and thickness dimensions of the element 3 will be described.

The entire length l of the element 3 of the slide fastener chain 1 according to the present embodiment is preferably 3.7 mm to 4.0 mm. Namely, it is preferable that a ratio Rtl of the thickness t of the element 3 to the entire length l of the element 3 satisfies the following equation (7).

$$0<Rtl<60\% \quad (7)$$

Also, it is more preferable that Rtl satisfies the following equation (7')

$$0<Rtl\leq55\% \quad (7')$$

For example, for each of Samples 1 to 8 shown in Table 1, the ratio of the thickness t of the element 3 to the entire length l of the element 3 is calculated as the following values.

$$1.8/3.7\times100=48.6\%$$

$$1.8/4.0\times100=45.0\%$$

$$2.0/3.7\times100=54.0\%$$

$$2.0/4.0\times100=50.0\%$$

Also, even when the thickness t of the element 3 is slightly thicker than that of each sample, a fastener which has flexibility and also a thinner form, which does not conventionally exist, and is excellent in design ability can be obtained if the ratio of the thickness t of the element 3 to the entire length l of the element 3 is set to below 60% as in the following.

$$2.2/3.7\times100=59.4\%$$

$$2.2/4.0\times100=55.0\%$$

On the other hand, for the comparative object shown in Table 1, the ratio of the thickness t of the element 3 to the entire length l of the element 3 is calculated as the following values.

$$2.6/3.7\times100=70.2\%$$

$$2.6/4.0\times100=65.0\%$$

As described above, the element 3 of the slide fastener chain 1 according to the present embodiment is configured so that the ratio of the thickness t of the element 3 to the entire length l of the element 3 is set to below 60%. Accordingly, a slide fastener chain which includes thinner elements 3 and has flexibility enough to be smoothly bent with a smaller curvature radius can be provided.

As described above, the slide fastener chain 1 of the present embodiment includes a pair of fastener tapes 2 and a plurality of elements 3 fixed on each of opposing edge portions 21 of the fastener tapes 2 at a predetermined pitch, wherein the elements 3 include base portions 31*a* and 32*a* fixed on the respective fastener tape 2 and head portions 31*c* and 32*c* protruding from the base portions 31*a* and 32*a* and configured to be engaged with the opposing elements 3, wherein a ratio Rt of the sum dimension of a first partial thickness ta, which is measured from an upper surface 3*c* of each element 3 to an upper surfaces-side apex 211 of the respective edge portion 21, and a second partial thickness tb, which is measured from a lower surface 3*d* of the element 3 to a lower surface-side apex 212 of the edge portion 21, to a thickness t of the element 3 satisfies the following equation (6), and wherein a ratio Rtl of the thickness t of the element 3 to the entire length l of the element 3 satisfies the following equation (7).

$$40\% \leq Rt \quad (6)$$

$$0 < Rtl < 60\% \quad (7)$$

Accordingly, a slide fastener chain 1, which includes thin elements, has flexibility enough to be smoothly bent with a smaller curvature radius and also has a necessary and sufficient strength, can be provided.

Also, in the slide fastener chain 1 of the present embodiment, the ratio Rtl of the thickness t of the element 3 to the entire length l of the element 3 satisfies the following equation (7').

$$0 < Rtl \leq 55\% \quad (7')$$

Accordingly, a slide fastener chain 1 which includes thinner elements 3 and has flexibility enough to be smoothly bent with a smaller curvature radius can be provided.

Also, in the slide fastener chain 1 of the present embodiment, the ratio Rt of the sum dimension of the first partial thickness ta, which is measured from the upper surface 3*c* of the element 3 to the upper surfaces-side apex 211 of the edge portion 21, and the second partial thickness tb, which is measured from the lower surface 3*d* of the element 3 to the lower surface-side apex 212 of the edge portion 21, to the thickness t of the element 3 satisfies the following equation (6').

$$45\% \leq Rt \quad (6')$$

Accordingly, a slide fastener chain 1 which has a more necessary and sufficient strength, can be provided.

Also, in the slide fastener chain 1 of the present embodiment, the thickness t and a pitch p of the element 3 satisfy the following equations (1) and (2).

$$0 < t \leq 2.2 \text{ mm} \quad (1)$$

$$0 < p \leq 3.5 \text{ mm} \quad (2)$$

Accordingly, a slide fastener chain which includes thin elements and has flexibility enough to be smoothly bent with a smaller curvature radius can be provided.

Further, in the slide fastener chain 1 of the present embodiment, the thickness t of the element 3 satisfies the following equation (1').

$$0 < t \leq 2.0 \text{ mm} \quad (1')$$

Accordingly, a slide fastener chain which includes thinner elements and has flexibility enough to be smoothly bent with a smaller curvature radius can be provided.

Also, in the slide fastener chain 1 of the present embodiment, a maximum load F occurred when a loop portion 1*a* formed by bending the slide fastener chain with the elements 3 engaged is pressed from above satisfies the following equation (3).

$$0 < F \leq 6.5 \text{ N} \quad (3)$$

Accordingly, a slide fastener chain which is thinner and more flexible can be provided.

Further, in the slide fastener chain 1 of the present embodiment, when one side of the slide fastener chain with the elements 3 engaged is fixed and the other side is rotated about the fixed one side, an average value α of an inclination (α+) of a load with respect to a curvature in the curvature of between 0.5 and 1.5 and an inclination (α−) in the curvature of between −0.5 and −1.5 satisfies the following equation (4).

$$0 < \alpha \leq 60 \times 10^{-4} \text{ Nm/m} \quad (4)$$

Accordingly, a slide fastener chain which is thinner and more flexible can be provided.

Further, in the slide fastener chain 1 of the present embodiment, a dimension of a minimum gap δ between the adjacent elements 3 is 0.4 mm or more. Accordingly, a slide fastener chain which is thinner and more flexible can be provided.

Further, the slide fastener 10 of the present embodiment includes the slide fastener chain 1, stops 4 and 5 fixed on the edge portions 21 of the fastener tapes 2 at terminating ends of element rows 3' formed by the plurality of elements 3 and a slider 6 movable to engage or disengage the element rows 3' with or from each other. Accordingly, a thin and flexible slide fastener can be provided.

In the foregoing, although various embodiments of the present invention have been described, the present invention is not limited to the foregoing embodiments, and accordingly, any other embodiments constructed by appropriately combining configurations of the foregoing embodiments are intended to be encompassed by the scope of the invention.

The invention claimed is:

1. A slide fastener chain, comprising:

a pair of fastener tapes; and a plurality of elements fixed on each of opposing edge portions of the fastener tapes at a predetermined pitch;

wherein each element comprises a base portion fixed on the respective fastener tape and a head portion protruding from the base portion and configured to be engaged with an opposing element of the plurality of elements, wherein a ratio of a sum dimension of a first partial thickness, which is measured from an upper surface of each element to an upper surfaces-side apex of the respective edge portion, and a second partial thickness, which is measured from a lower surface of the element to a lower surface-side apex of the edge portion, to a thickness of the element is greater than or equal to 40%, wherein the thickness of the element is defined by the upper surface of the element which extends over an upper base portion and an upper head portion and by the lower surface of the element which extends over a lower base portion and a lower head portion, and wherein a ratio of the thickness of the element to the entire length of the element from the base portion to the head portion is less than 60%, wherein the entire length of the element from the base portion to the head portion is defined by a first end that corresponds to a distal end of the upper head portion and a distal end of the lower head portion and a second end that corresponds to a distal end of the upper base portion and a distal end of the lower base portion.

2. The slide fastener chain according to claim 1, wherein the ratio of the thickness of the element to the entire length of the element is less than or equal to 55%.

3. The slide fastener chain according to claim 1, wherein the ratio of the sum dimension of the first partial thickness, which is measured from the upper surface of the element to the upper surfaces-side apex of the edge portion, and the second partial thickness, which is measured from the lower surface of the element to the lower surface-side apex of the edge portion, to the thickness of the element is greater than or equal to 45%.

4. The slide fastener chain according to claim 1, wherein the thickness is less than or equal to 2.2 mm and the predetermined pitch of the element is less than or equal to 3.5 mm.

5. The slide fastener chain according to claim 4, wherein the thickness of the element is less than or equal to 2.0 mm.

6. The slide fastener chain according to claim 1, wherein a maximum load when a loop portion formed by bending the slide fastener chain with the elements engaged is pressed from above is less than or equal to 6.5 N.

7. The slide fastener chain according to claim 1, wherein when a first side of the slide fastener chain with the elements engaged is fixed and a second side is rotated about the first side, an average value of an inclination of a load in a curvature of between 0.5 and 1.5 and an inclination in a curvature of between −0.5 and −1.5 is less than or equal to $60\times10^{-4}$ Nm/m.

8. The slide fastener chain according to claim 1, wherein a dimension of a minimum gap between adjacent elements of the plurality of elements is 0.4 mm or more.

9. A slide fastener, comprising:

the slide fastener chain according to claim 1;

stops fixed on the edge portions of the fastener tapes at terminating ends of element rows formed by the plurality of elements; and a slider movable to engage or disengage the element rows with or from each other.

* * * * *